United States Patent [19]

Rhoades et al.

[11] 4,363,417

[45] Dec. 14, 1982

[54] DUSTLESS CONTAINER FOR ASHES OR THE LIKE

[76] Inventors: Deo A. Rhoades; Betty L. Rhoades, both of Rte. 1, Grand Junction, Mich. 49056

[21] Appl. No.: 202,164

[22] Filed: Oct. 30, 1980

[51] Int. Cl.[3] ..... B65D 25/28

[52] U.S. Cl. ..... 220/1 T; 126/242; 232/38; 232/44

[58] Field of Search ..... 220/1 T, 356, 94 A; 126/242, 243, 244, 223, 224; 110/165 R, 166; 232/44, 43.3, 43.1, 38, 47

[56] References Cited

U.S. PATENT DOCUMENTS

| | | | |
|---|---|---|---|
| 551,174 | 12/1895 | Stretton | 126/242 |
| 757,435 | 4/1904 | Blum | 126/242 |
| 827,482 | 7/1906 | Van Dorn | 232/38 |
| 1,765,871 | 6/1930 | Johnson | 126/242 |
| 2,869,780 | 1/1959 | Jensen | 232/44 |
| 3,390,804 | 7/1968 | Morgan | 220/1 T |

FOREIGN PATENT DOCUMENTS

| | | | |
|---|---|---|---|
| 794083 | 4/1958 | United Kingdom | 220/1 T |
| 1500504 | 2/1978 | United Kingdom | 220/1 T |

*Primary Examiner*—Daniel J. O'Connor

*Attorney, Agent, or Firm*—Burmeister, York, Palmatier, Hamby & Jones

[57] ABSTRACT

A dustless container for ashes or the like, comprising a receptacle having a bottom wall, a semicylindrical front wall portion extending upwardly therefrom, a flat vertical rear wall extending upwardly from the bottom wall opposite the front wall portion, and side wall portions extending between the front wall portion and the rear wall, and a cover for opening and closing the top of the receptacle, the flat vertical rear wall being adapted to stand close to a wall of a room in which the container is kept. The receptacle has an opening formed in the upper portion of the rear wall, a flat plate-like door, a plate-like deflector connected to the lower end portion of the door and extending through the lower portion of the opening into the receptacle for deflecting ashes into the receptacle and away from the opening, the door being swingable about its lower end portion between a closed position against the outside of the rear wall and an open position with the upper portion of the door swung away from the rear wall, the deflector being of a width corresponding to the width of the opening, the door being of a width greater than the width of the opening to remain outside of the opening, a pair of plate-like side members connecting with the back of the door and extending therefrom through the opening into the receptacle.

7 Claims, 12 Drawing Figures

DUSTLESS CONTAINER FOR ASHES OR THE LIKE

FIELD OF THE INVENTION

This invention relates to a dustless container for ashes or the like, such as fireplace ashes or ashes from a wood burning stove, for example.

OBJECTS OF THE INVENTION

One object of the present invention is to provide a new and improved container, into which ashes may be placed without raising any significant amount of dust.

A further object is to provide such a new and improved container which is constructed so as to prevent any significant amount of dust from escaping from the container.

Another object is to provide a dustless ash container which will stand close to a wall in the room in which the container is kept, whereby the container will occupy a minimum amount of space.

SUMMARY OF THE INVENTION

To achieve these and other objects, the present invention may provide a dustless container for ashes or the like, comprising a receptacle having a bottom wall, side wall means extending upwardly from the bottom wall and enclosing the sides of the receptacle, the side wall means including a substantially flat vertical wall, a cover for opening and closing the top of the receptacle, the wall having an entry opening in the upper portion thereof, a flat plate-like door for opening and closing the entry opening, a plate-like deflector connected to the lower end portion of the door and extending through the lower portion of the entry opening into the receptacle for deflecting ashes into the receptacle and away from the opening when the door is opened, the door being swingable about its lower end portion between a closed position against the outside of the wall to close the opening and an open position with the upper portion of the door swung away from the wall to open the opening, the deflector being of a width corresponding generally to the width of the opening to fit through the opening, the door being of a width greater than the width of the opening to remain outside of the opening, a pair of plate-like side members connecting with the back of the door and extending from the door and through the opening into the receptacle for guiding the ashes into the receptacle, the door together with the deflector and the side members forming a chute for conveying the ashes into the receptacle, and stop means on at least one of the side members for limiting the outward swinging movement of the door, the stop means being engageable with the inner side of the wall adjacent the opening.

The upper end portion of the deflector is preferably offset from the lower end portion of the door into the inside of the receptacle, the deflector and the door preferably having a connecting portion therebetween which is angularly related to the deflector and the door, the wall of the receptacle having an upwardly facing edge forming the lower boundary of the opening, the connecting portion forming a downwardly facing ledge which rests upon the upwardly facing edge and provides a hinge-like support for the door.

The stop means may comprise a lateral projection on at least one of the side members for engaging the inner side of the wall adjacent a lateral edge of the opening, the corresponding side member being flexible laterally into the opening to provide for the passage of the projection through the opening for the removal of the side members and the deflector from the opening along with the removal of the door from the receptacle.

Moreover, the present invention may provide a dustless container for ashes or the like, comprising a receptacle having a bottom wall, and side wall means extending upwardly from the bottom wall and enclosing the sides of the receptacle, and a cover for opening and closing the top of the receptacle, the receptacle including recess means forming a toe receiving recess in the side wall means of the receptacle, the recess being adapted to receive a toe portion of one foot of the user of the container, the recess means including an upwardly facing wall portion for engagement by the toe of the user to hold down the receptacle, the cover having a handle located thereon in generally overlying relation to the recess means for use in lifting the cover while the receptacle is held down by the toe of the user.

The invention may also provide a dustless container for ashes or the like, comprising a receptacle having a bottom wall, a semicylindrical front wall portion extending upwardly from the bottom wall, a flat substantially vertical rear wall extending upwardly from the bottom wall opposite the front wall portion, the flat substantially vertical rear wall being adapted to stand close to the wall of a room in which the container is kept, and side wall portions extending between the front wall portion and the rear wall, and a cover for opening and closing the top of the receptacle.

The entry opening may be formed in the upper portion of the rear wall. The cover may have a downwardly projecting flange extending around the periphery of the cover and fitting snugly around the upper portion of the receptacle.

BRIEF DESCRIPTION OF THE DRAWINGS

Further objects, advantages and features of the present invention will appear from the following description, taken with the accompanying drawings, in which.

DETAILED DESCRIPTION OF THE ILLUSTRATIVE EMBODIMENT

Figure 6:
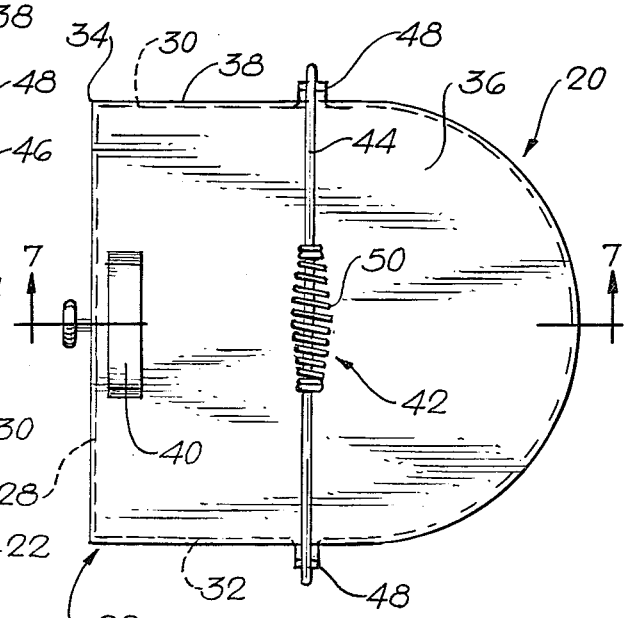
FIG. 6 is a top plan view of the container.
Figure 8:
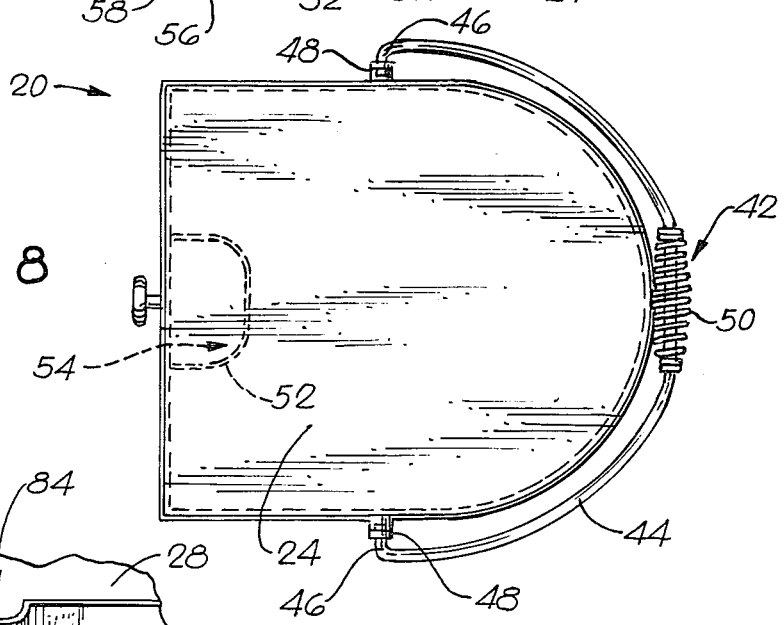
FIG. 8 is a bottom view of the container.
Figure 9:
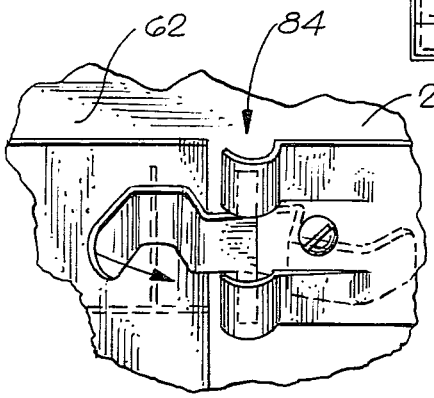
FIG. 9 is a fragmentary enlarged perspective, showing a buckle for holding the door in its closed position.

As just indicated, the drawings illustrate a dustless container 20 for holding ashes or the like, such as ashes from a fireplace or a stove, for example. The illustrated container 20 comprises a receptacle 22 having a bottom wall 24 and side wall means extending upwardly from the bottom wall. Such side wall means may preferably comprise a semicylindrical front wall 26, a flat substantially vertical rear wall 28, and a pair of side walls 30 and 32 extending between the semicylindrical front wall 26 and the opposite edges of the rear wall 28. It will be seen from FIGS. 6 and 8 that the top and bottom of the receptacle 22 are generally D-shaped. The receptacle 22 is preferably made of sheet metal.

The side wall means 26, 28, 30 and 32 enclose the sides of the receptacle 22 and form a top opening which is adapted to be closed by a cover 34 which is movable or removable, for opening and closing the top of the receptacle. It will be seen that the cover 34 has a generally D-shaped top wall 36, corresponding in shape to the top of the receptacle 22. The cover 34 has a downwardly projecting peripheral flange 38, projecting downwardly from the top wall 36, and extending around the periphery of the cover 34. The flange 38 fits snugly around the top of the receptacle 22, so as to prevent the escape of any significant amount of dust from the receptacle. The cover 34 is provided with a handle 40, for use in lifting the cover upwardly from the receptacle 22, when the receptacle is to be opened, to dump out the ashes therein.

The flat vertical rear wall 28 is adapted to stand close to one of the walls of the room in which the ash container 20 is kept. Thus, the space occupied by the ash container 20 is minimized. The semicylindrical front wall portion 26 increases the capacity of the container 20 and makes it easier to dump the ashes from the container in a controlled manner.

Figure 3:
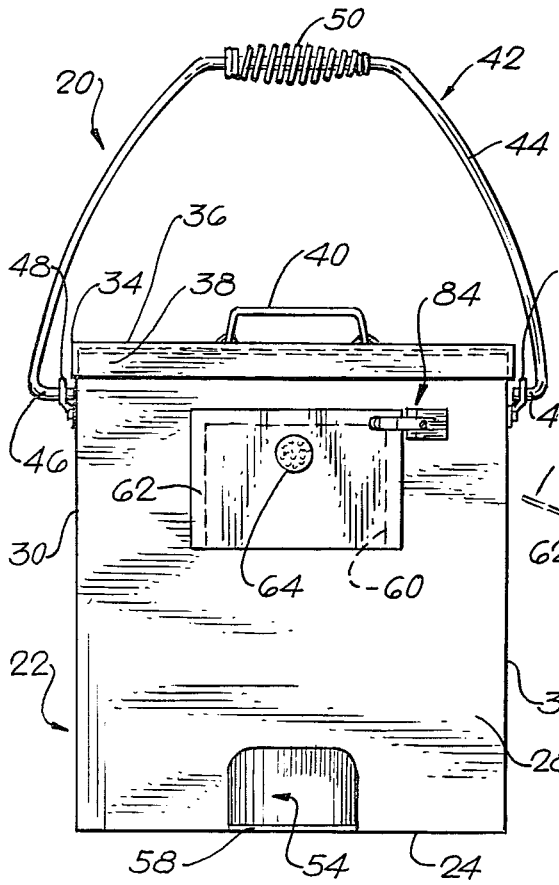
FIGS. 3, 4 and 5 are rear, side and front elevational views of the container of FIG. 1.
Figure 4:
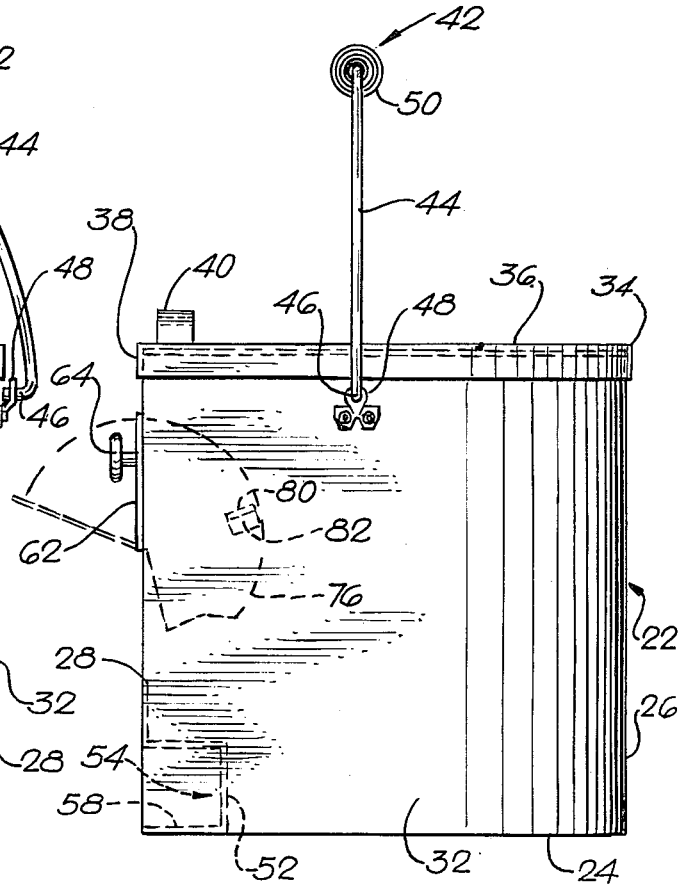
Figure 5:
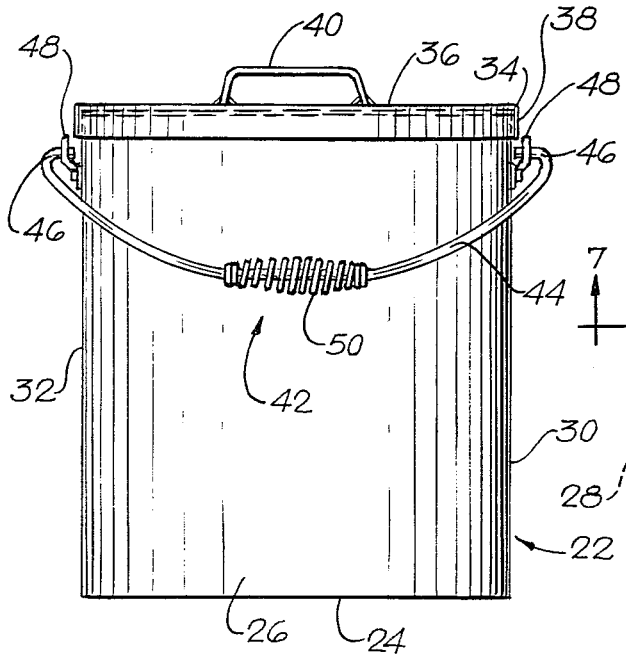

The container 22 has a handle 42, comprising a generally C-shaped bail 44 which is pivotally connected to the upper portions of the side walls 30 and 32. Thus, the bail 44 is in the form of a generally C-shaped metal rod having end portions 46 which are bent inwardly so as to form diametrically opposite pivots, received in a pair of apertured brackets 48 which are secured to the opposite side walls 30 and 32. The bail 44 is thus swingable between its erected position, as shown in FIGS. 3 and 4, and its lowered position, as shown in FIG. 5. A hand grip member 50 may be provided around the central portion of the bail 44, to afford heat insulation and a more comfortable grip. As shown, the hand grip member 50 is in the form of a spring coil, made of wire.

Figure 7:
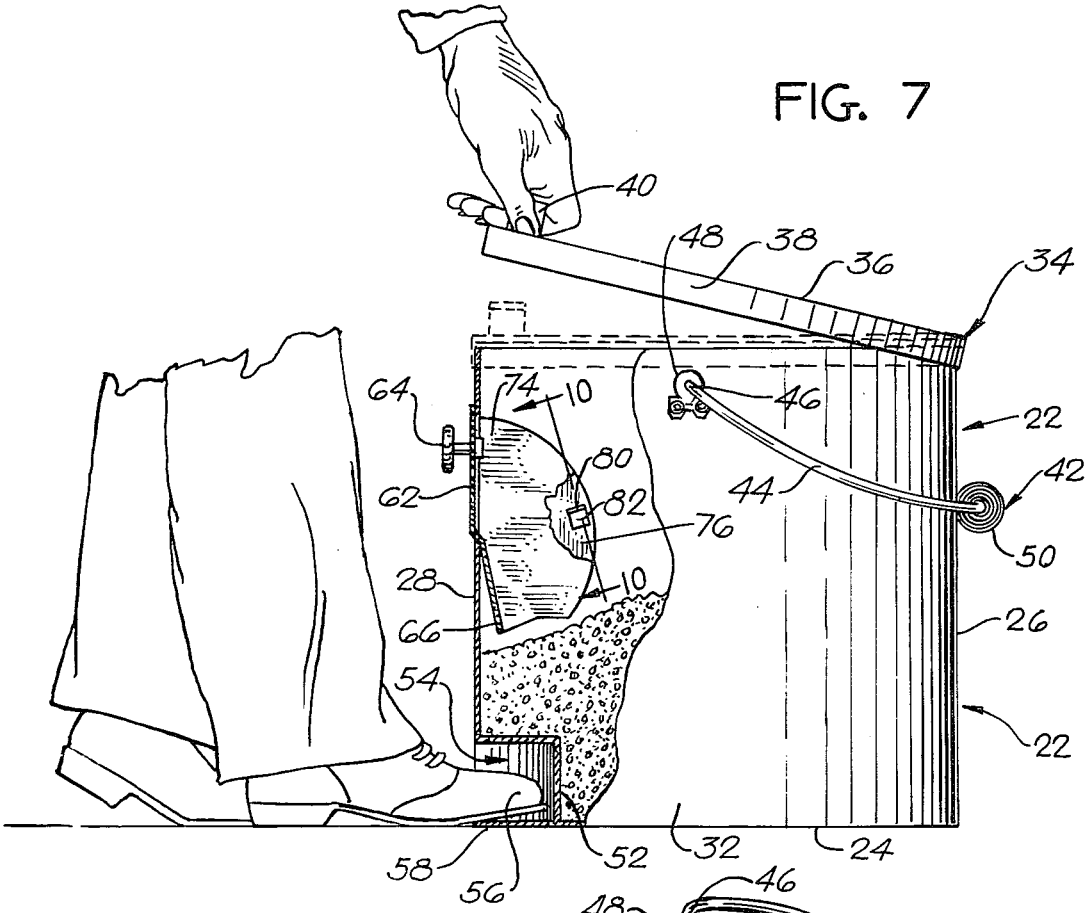
FIG. 7 is a side elevational view, partly in section, generally along the line 7—7 in FIG. 6.

The receptacle 22 preferably has toe recess means 52, forming a toe recess 54, adapted to receive the toe portion 56 of one foot of the user, as shown in FIG. 7. It will be seen from FIGS. 3 and 4 that the toe recess 54 extends into the lower portion of the flat rear wall 28 and is centrally disposed between the side walls 30 and 32. The toe recess means 52 may take the form of a generally box-like housing, inset into the lower portion of the rear wall 28 and connected between the rear wall 28 and the bottom wall 24. The toe recess 54 has an upwardly facing wall portion 58, adapted to be engaged by the toe 56 of the user, to hold down the receptacle 22, when the cover 34 is being lifted from the receptacle 22. As shown, the wall portion 58 is a portion of the bottom wall 24.

The handle 40 is secured to the cover 34 in a location which generally overlies the toe recess 54, so that the upward pull on the handle 40, when the cover 34 is removed, will be generally aligned with the downward force exerted by the toe 56 of the user of the wall 58 of the toe recess 54. In this way, the removal of the cover 34 is facilitated even though the cover may fit quite snugly around the upper end of the receptacle 22.

To provide for the placement of ashes in the ash container 20, the receptacle 22 is preferably provided with a generally rectangular entry opening 60, formed in the upper portion of the flat rear wall 28. The opening 60 is adapted to be opened and closed by a flat plate-like door 62, which is preferably swingable about its lower edge portion, between its closed and open positions, as shown in full and broken lines in FIG. 4. The door 62 is larger in width and height than the entry opening 60, so that the door 62 fully covers the opening 60, when the door is in its closed position, against the flat rear wall 28, as shown in full lines in FIGS. 3 and 4. The door 62 is moved to its open position by swinging the upper portion of the door 62 away from the flat rear wall 28, as shown in broken lines in FIG. 4. A knob or handle 64 is preferably provided on the door 62, for use in opening and closing the door.

Figure 11:
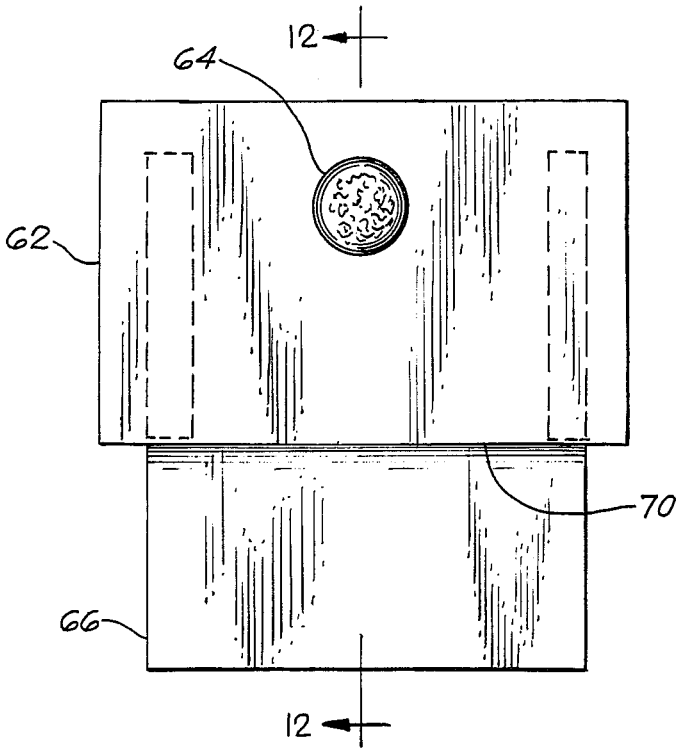
FIG. 11 is a front view of the door and the deflector, removed from the container.

The door 62 preferably carries a plate-like deflector 66, having its upper portion connected to the lower portion of the door 62. The deflector 66 extends through the entry opening 60, into the space within the receptacle 22. The deflector 66 has a width corresponding to the width of the opening 60, to fit through the opening. It will be seen from FIG. 11 that the width of the deflector 66 is substantially less than the width of the door 62.

Figure 12:
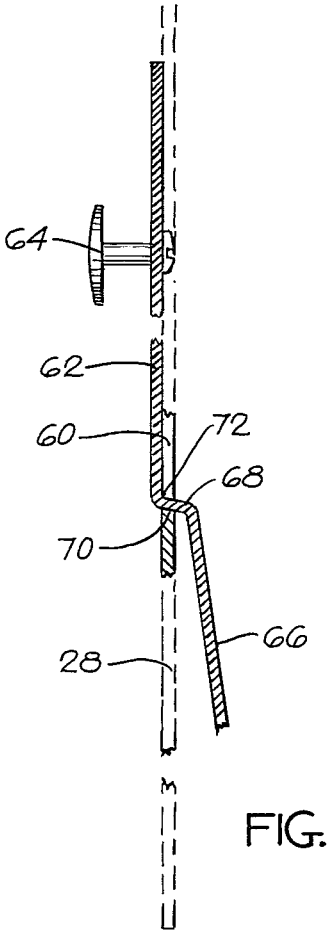
FIG. 12 is a fragmentary enlarged section, corresponding to a portion of FIG. 7 and taken along the line 12—12 in FIG. 11.
Figure 10:
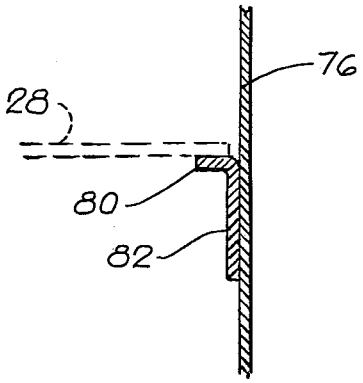
FIG. 10 is a fragmentary detail view, taken generally as indicated by the line 10—10 in FIG. 7.

As shown in FIGS. 7 and 12, the upper portion of the deflector 66 is preferably offset inwardly from the lower portion of the door 62, such offset being directed toward the inside of the receptacle 22. As shown to best advantage in FIG. 12, a connecting portion 68 is provided between the lower portion of the door 62 and the upper portion of the deflector 66. The connecting portion 68 is angularly related to the door 62 and the deflector 66, to provide a Z-shaped or zig-zag configuration. The connecting portion 68 provides a downwardly facing ledge 70 which rests upon and is supported by an upwardly facing edge 72 at the lower boundary of the entry opening 60, such edge 72 being formed on the rear wall 28 of the receptacle 22. The engagement of the ledge 70 and the edge 72 affords a hinge-like support for the lower portion of the door 62.

Figure 2:
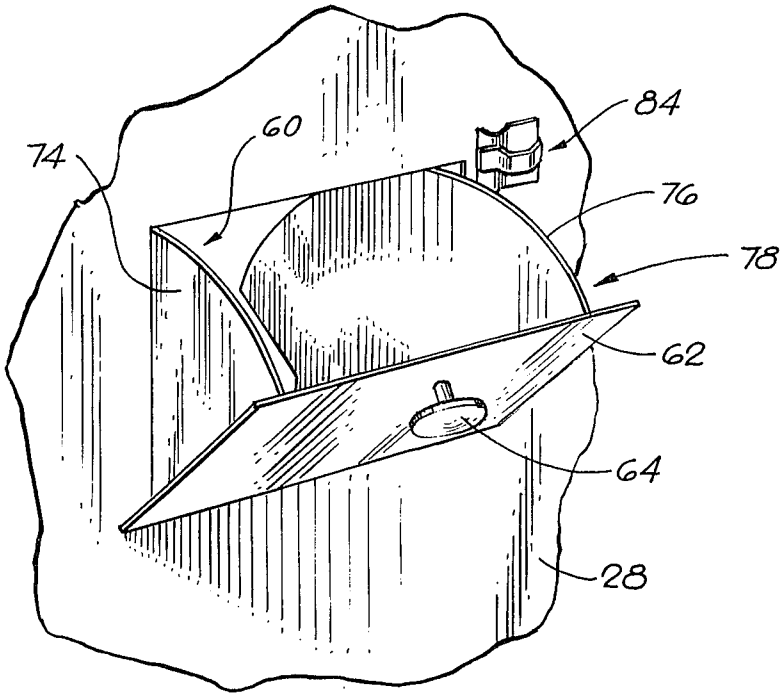
FIG. 2 is a fragmentary enlarged perspective view, showing the ash entry door in its open position.

The deflector 66 is adapted to deflect the ashes into the receptacle 22 and away from the opening 60, when the door 62 is open, as shown in FIG. 2. The deflector 66 causes the ashes to pile up in the receptacle 22 away from the opening 60, so that a much greater quantity of ashes can be placed in the receptacle 22, before there is any tendency of the ashes to overflow through the entry opening 60.

The deflector 66 is preferably tilted at an angle relative to the angle of the door 62, so that the angle between the door 62 and the deflector 66 is somewhat less than 180°.

The swingable door 62 also preferably carries a pair of side members 74 and 76, as shown in FIGS. 2 and 7. The side members 74 and 76 are connected to the back of the door 62 and extend through the entry opening 60, to afford lateral containment for the ashes when they are shovelled through the opening 60 into the receptacle 22. As shown in FIG. 2, the lower edge portions of the side mambers 74 and 76 are preferably connected to the deflector 66, as well as to the back of the door 62. The deflector 66, the door 62, and the side members 74 and 76 form a chute 78 which guides the ashes into the receptacle 22, through the entry opening 60.

The outward swinging movement of the door 62 is preferably limited by stop means on at least one of the side members 74 and 76, such stop means being illustrated as a flange or projection 80, extending laterally in an outward direction from each of the side members 74 and 76. The illustrated projections 80 are formed on brackets 82, secured to the side members 74 and 76, but the projections 80 could be formed integrally with the side members 74 and 76. The projections 80 are engageable with the rear wall 28, adjacent the lateral edges of the entry opening 60.

To provide for the removal and installation of the chute 78, the side members 74 and 76 are flexible laterally into the opening 60, so that the projections 80 will pass through the opening 60. When the side members 74 and 76 are thus flexed toward each other, the side members can readily be removed from the opening 60, along with the entire chute 78, which also includes the door 62 and the deflector 66. When the chute 78 is to be reinstalled, the side members 74 and 76 are flexed toward each other so that the projections or flanges 80 will pass through the opening 60 in the rear wall 28.

Spring means may be provided to hold the door 62 tightly closed, so that dust will not escape through the entry opening 60. Such spring means may assume various forms, such as the illustrated spring buckle 84 which acts between the rear wall 28 and the door 62. Various other spring means may be employed to hold the door 62 in its closed position.

When ashes or the like are to be placed in the container 20, the spring buckle 84 is released, and the access door 62 is swung outwardly to its open position, as shown in FIG. 2. The outward swinging movement is limited by the engagement of the projections 80 with the inside of the rear wall 28. The ashes are shovelled or otherwise placed in the chute 78, formed by the door 62, the deflector 66, and the side members 74 and 76.

Figure 1:
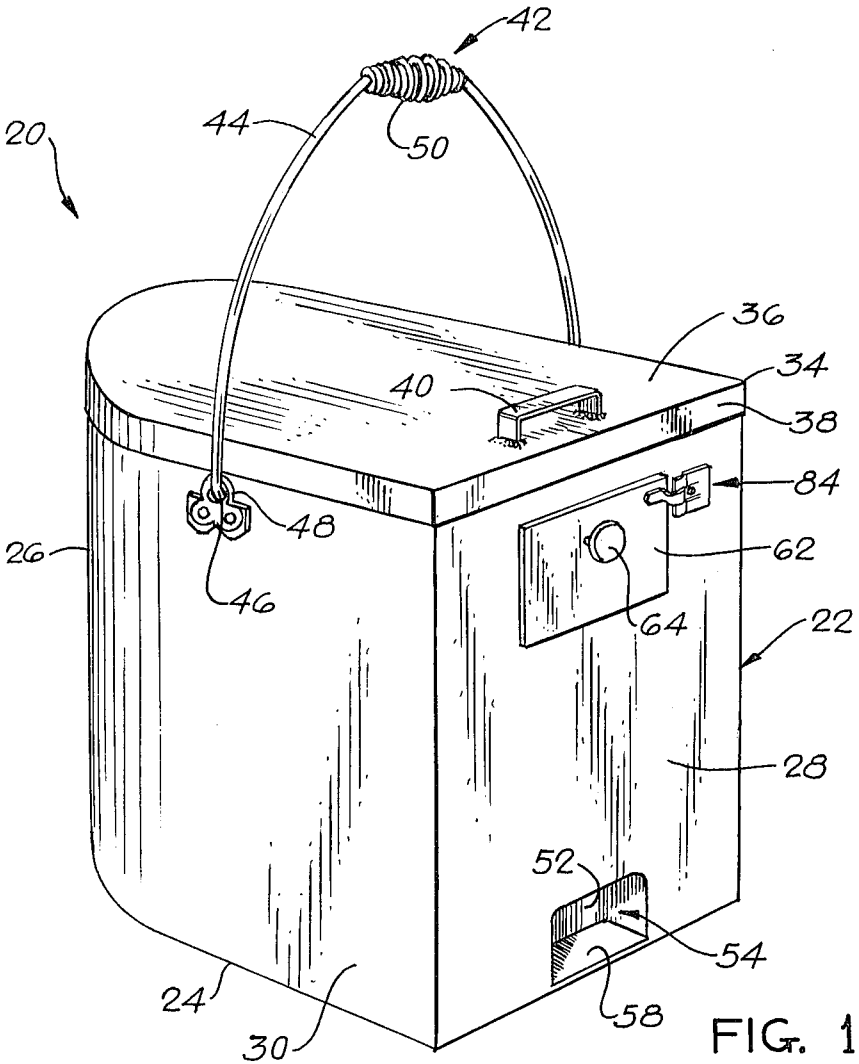
FIG. 1 is a perspective view showing a dustless ash container, to be described as an illustrative embodiment of the present invention.

When the door 62 is swung closed, as shown in FIGS. 1, 3 and 7, the ashes slide along the chute 78, into the receptacle 22. The deflector 66 deflects the ashes away from the opening 60, so that the top of the pile of ashes in the receptacle 22 is away from the opening 60.

The closing of the door 62 prevents the escape of any significant amount of dust from the container 20. The spring buckle 84 may be employed to hold the door tightly closed.

When the dustless ash container 20 is not being actively used, the container may be located with the flat rear wall 28 standing close to one of the walls of the room in which the container is kept. Thus, the container 20 will occupy a minimum of space.

The tightly fitting cover 34 on the container 20 prevents the escape of any significant amount of dust. When the container 20 is to be dumped, the container is carried to a dumping location. To remove the cover 34, the user inserts one toe 56 into the toe recess 54, to apply downward force against the wall or flange 58. In this way, the receptacle 22 is held down. The cover 34 is then removed by applying a lifting force to the handle 40, as shown in FIG. 7. The ashes can then be readily dumped out of the receptacle 22, using the semicylindrical wall portion 26 as a pouring spout. The cover 34 is then replaced on the receptacle 22.

We claim:

1. A dustless container for ashes or the like, comprising a receptacle having a bottom wall, a semi-cylindrical front wall portion extending upwardly from said bottom wall, a flat substantially vertical rear wall extending upwardly from said bottom wall opposite said front wall portion, and side wall portions extending between said front wall portion and said rear wall, a cover for opening and closing the top of said receptacle, said rear wall having an entry opening in the upper portion thereof, a flat plat-like door for opening and closing said entry opening, a plate-like deflector connected to the lower end of said door and extending through the lower portion of said entry opening into said receptacle for deflecting ashes into said receptacle and away from said opening when said door is open, said door being swingable about its lower edge portion between a closed position against the outside of said rear wall to close said opening and an open position with the upper portion of said door swung away from said rear wall to open said opening, said deflector being of a width corresponding generally to the width of said opening to fit through said opening, said door being of a width greater than the width of said opening to remain outside of said opening, a pair of plate-like side members connecting with the back of said door and extending from said door and through said opening into said receptacle for guiding the ashes into said receptacle, said door together with said deflector and said side members forming a downwardly sloping conveyance chute for conveying the ashes into said receptacle, and stop means on at least one of said side members for limiting the outward swinging movement of said door, said stop means being engageable with the inner side of said rear wall adjacent said opening, the upper edge portion of said deflector being offset from said door into the inside of said receptacle, said deflector and said door having a connecting portion therebetween which is angularly related to said deflector and said door, said rear wall of said receptacle having an upwardly facing edge forming the lower boundary of said opening, said connecting portion forming a downwardly facing ledge which rests upon said upwardly facing edge and provides a hinge-like support for said door.

2. A container according to claim 1, said stop means comprising a lateral projection on at least one of said side members for engaging the inner side of said rear wall adjacent a lateral edge of said opening, the corresponding side member being flexiable laterally into said opening to provide for the passage of said projection through said opening for the removal of said side members and said deflector from said opening along with the removal of said door from said receptacle.

3. A container according to claim 1, said stop means being in the form of lateral projections on said side members and engageable with the inner side of said rear wall adjacent the opposite lateral edges of said opening, said side members being flexible into said opening to provide for the passage of said projections through said opening for the removal of said side members and said deflector from said opening along with the removal of said door from said receptacle.

4. A dustless container for ashes or the like, comprising a receptacle having a bottom wall, side wall means extending upwardly from said bottom wall and enclosing the sides of said receptacle, said side wall means including a substantially flat vertical wall, a cover for opening and closing the top of said receptacle, said wall having an entry opening in the upper portion thereof, a flat plate-like door for opening and closing said entry opening, a plate-like deflector connected to the lower end portion of said door and extending through the lower portion of said entry opening into said receptacle for deflecting ashes into said receptacle and away from said opening when said door is open, said door being swingable about its lower end portion between a closed position against the outside of said wall to close said opening and an open position with the upper portion of said door swung away from said wall to open said opening, said deflector being of a width corresponding generally to the width of said opening to fit through said opening, said door being of a width greater than the width of said opening to remain outside of said opening, a pair of plate-like side members connecting with the back of said door and extending from said door and through said opening into said receptacle for guiding the ashes into said receptacle, said door together with said deflector and said side members forming a downwardly sloping conveyance chute for conveying the ashes into said receptacle, and stop means on at least one of said side members for limiting the outward swinging movement of said door, said stop means being engageable with the inner side of said vertical wall adjacent said opening.

5. A container according to claim 4, said stop means comprising a lateral projection on at least one of said side members for engaging the inner side of said wall adjacent a lateral edge of said opening, the corresponding side member being flexible laterally into said opening to provide for the passage of said projection through said opening for the removal of said side members and said deflector from said opening along with the removal of said door from said receptacle.

6. A container according to claim 4, said stop means comprising lateral projections on said side members and engageable with the inner side of said wall adjacent the opposite lateral edges of said opening, said side members being flexible into said opening to provide for the passage of said projections through said opening for the removal of said side members and said deflector from said opening along with the removal of said door from said receptacle.

7. A dustless container for ashes or the like, comprising a receptacle having a bottom wall, side wall means extending upwardly from said bottom wall and enclosing the sides of said receptacle, said side wall means including a substantially flat vertical wall, a cover for opening and closing the top of said receptacle, said wall having an entry opening in the upper portion thereof, a flat plate-like door for opening and closing said entry opening, a plate-like deflector connected to the lower end portion of said door and extending through the lower portion of said entry opening into said receptacle for deflecting ashes into said receptacle and away from said opening when said door is open, said door being swingable about its lower end portion between a closed position against the outside of said wall to close said opening and an open position with the upper portion of said door swung away from said wall to open said opening, said deflector being of a width corresponding generally to the width of said opening to fit through said opening, said door being of a width greater than the width of said opening to remain outside of said opening, a pair of plate-like side members connecting with the back of said door and extending from said door and through said opening into said receptacle for guiding the ashes into said receptacle, said door together with said deflector and said side members forming a downwardly sloping conveyance chute for conveying the ashes into said receptacle, and stop means on at least one of said side members for limiting the outward swinging movement of said door, said stop means being engageable with the inner side of said vertical wall adjacent said opening, the upper end portion of said deflector being offset from the lower end portion of said door into the inside of said receptacle, said deflector and said door having a connecting portion therebetween which is angularly related to said deflector and said door, said wall of said receptacle having an upwardly facing edge forming the lower boundary of said opening, said connecting portion forming a downwardly facing ledge which rests upon said upwardly facing edge and provides a hinge-like support for said door.

* * * * *